United States Patent [19]

Budzich

[11] 4,222,409

[45] Sep. 16, 1980

[54] LOAD RESPONSIVE FLUID CONTROL VALVE

[76] Inventor: Tadeusz Budzich, 80 Murwood Dr., Moreland Hills, Ohio 44022

[21] Appl. No.: 949,250

[22] Filed: Oct. 6, 1978

Related U.S. Application Data

[60] Continuation-in-part of Ser. No. 773,421, Feb. 28, 1977, Pat. No. 4,122,865, and a continuation-in-part of Ser. No. 894,111, Apr. 17, 1978, Pat. No. 4,147,178, and a continuation-in-part of Ser. No. 894,112, Apr. 17, 1978, Pat. No. 4,140,152, said Ser. No. 894,111, is a continuation of Ser. No. 716,360, Aug. 20, 1976, Pat. No. 4,107,923, said Ser. No. 894,112, is a division of Ser. No. 716,360.

[51] Int. Cl.[3] ..... F15B 13/08

[52] U.S. Cl. ..... 137/596.13; 60/427; 91/436; 91/446; 137/596.1; 137/596.2; 137/625.68

[58] Field of Search ..... 60/427; 137/596.1, 596.13, 137/596.2, 625.68; 91/436, 446, 531

[56] References Cited

U.S. PATENT DOCUMENTS

| | | | |
|---|---|---|---|
| Re. 29,538 | 2/1978 | Budzich | 137/596.1 X |
| 3,768,372 | 10/1973 | McMillen | 91/531 X |
| 3,807,447 | 4/1974 | Masuda | 137/596.13 |
| 3,815,631 | 6/1974 | Shaw | 137/625.68 X |
| 3,998,134 | 12/1976 | Budzich | 137/596.1 X |
| 4,028,889 | 6/1977 | Budzich | 137/596.12 X |
| 4,122,865 | 10/1978 | Budzich | 137/596.13 |

*Primary Examiner*—Gerald A. Michalsky

[57] ABSTRACT

A direction flow control valve for control of positive and negative loads equipped with a load responsive positive load control which automatically regulates valve inlet pressure to maintain a relatively constant pressure differential between inlet pressure and load pressure. The load responsive control of direction flow control valve blocks the pump flow to the motor while controlling negative load, providing the motor inlet with fluid from the motor exhaust.

22 Claims, 2 Drawing Figures

LOAD RESPONSIVE FLUID CONTROL VALVE

This application is a continuation in part of applications Ser. No. 773,421, filed Feb. 28, 1977 for "Load Responsive Fluid Control Valve", now U.S. Pat. No. 4,122,865, Ser. No. 894,111, filed Apr. 17, 1978 for "Load Responsive Valve Assemblies", now U.S. Pat. No. 4,147,178 and Ser. No. 894,112, filed Apr. 17, 1978 for "Load Responsive Valve Assemblies", now U.S. Pat. No. 4,140,152, applications Ser. No. 894,111 and Ser. No. 894,112 being a continuation and division, respectively, of application Ser. No. 716,360, filed Aug. 20, 1976 for "Load Responsive Valve Assemblies", now U.S. Pat. No. 4,107,923.

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by one basic system disadvantage.

Normally in such a system the load responsive valve control can maintain a constant pressure differential and therefore constant flow characteristics when operating only one load at a time. With two or more loads, simultaneously controlled, only the highest of the loads will retain the flow control characteristics, the speed of actuation of lower loads varying with the change in magnitude of the highest load. A fluid control valve for such a system is shown in U.S. Pat. No. 3,488,953 issued to Haussler.

This drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1969. However, while these valves are effective in controlling positive loads they do not retain flow control characteristics when controlling negative loads, which instead of taking supply the energy to the fluid system and hence the speed of actuation of such a load in a negative load system will vary with the magnitude of the negative load. Especially with socalled overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they utilize a controlling orifice located in the motor exhaust during negative load mode of operation and therefore control the fluid flow out of the fluid motor. These valves also during control of negative loads supply the motor inlet with throttle down fluid from the pump circuit, therefore using flow from the pump, while controlling a negative load. In certain fluid power control systems it is preferable, while controlling a negative load, to supply fluid to the motor inlet from the motor exhaust circuit instead of using pump capacity.

These drawbacks can be overcome in part by provision of fluid control valves as disclosed in U.S. Pat. No. 3,807,447 issued to Masuda on Apr. 30, 1974. However, while these valves utilize actuator exhaust fluid for actuator inlet flow requirement when controlling negative loads and also utilize a controlling orifice located between the pump and the actuator while controlling positive and negative loads they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in fluid throttling loss. These valves are not adaptable to simultaneous control of multiple loads in parallel circuit and they do not provide system load control pressure signal to the pump flow control mechanism.

SUMMARY OF THE INVENTION

It is therefore a principal object of this invention to provide improved load responsive fluid direction and flow control valves which block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide load responsive fluid direction and flow control valves, which load responsive fluid direction and flow control valves are provided with a pressurized exhaust manifold, flow from which supplies the inlet flow requirements of motors controlling negative loads.

It is a further object of this invention to provide load responsive fluid direction and flow control valves which retain their control characteristics during control of positive loads, while responding to a pressure differential developed across a variable orifice located between the pump and the actuator and which retain their control characteristics during control of negative loads while responding to a pressure differential developed across a variable orifice located between actuator and exhaust manifold.

It is a further object of this invention to provide load responsive fluid direction and flow control valves, which are equipped with positive and negative load throttling controllers and which are provided with a sequencing device, which inactivates the negative load throttling controller, while the positive load throttling controller is controlling a positive load.

It is a further object of this invention to provide load responsive fluid direction and flow control valves, which load responsive fluid direction and flow control valves are provided with a pressurized exhaust manifold, flow of which supplies part of the inlet flow requirement of motors controlling negative loads, the additional inlet flow being supplied from pump outlet circuit.

It is still another object of this invention to provide load responsive fluid direction and flow control valves, which are equipped with a positive load controller and which are provided with a sequencing device, which isolates the control pressure signal from the positive load throttling controller, while the load responsive valve is controlling a negative load.

Briefly the foregoing and other additional objects and advantages of this invention are accomplished by providing a novel load responsive fluid control system for use during proportional simultaneous control of multiple positive and negative loads. A system pump is controlled in respect to pressure signal transmitted from system valves, corresponding to the highest system load pressure. Exhaust circuit of the system is pressurized, the exhaust flow being used to provide inlet flow requirements of motors controlling negative loads and if necessary supplemented from pump discharge circuit. Valve controls during control of positive and negative loads respond to pressure differentials developed across variable orifices in the actuator inlet and outlet.

Additional objects of this invention will become apparent when referring to the preferred embodiments of the invention as shown in the accompanying drawings and described in the following detailed description.

DESCRIPTION OF THE PREFERRED EMBODIMENT

Figure 1:
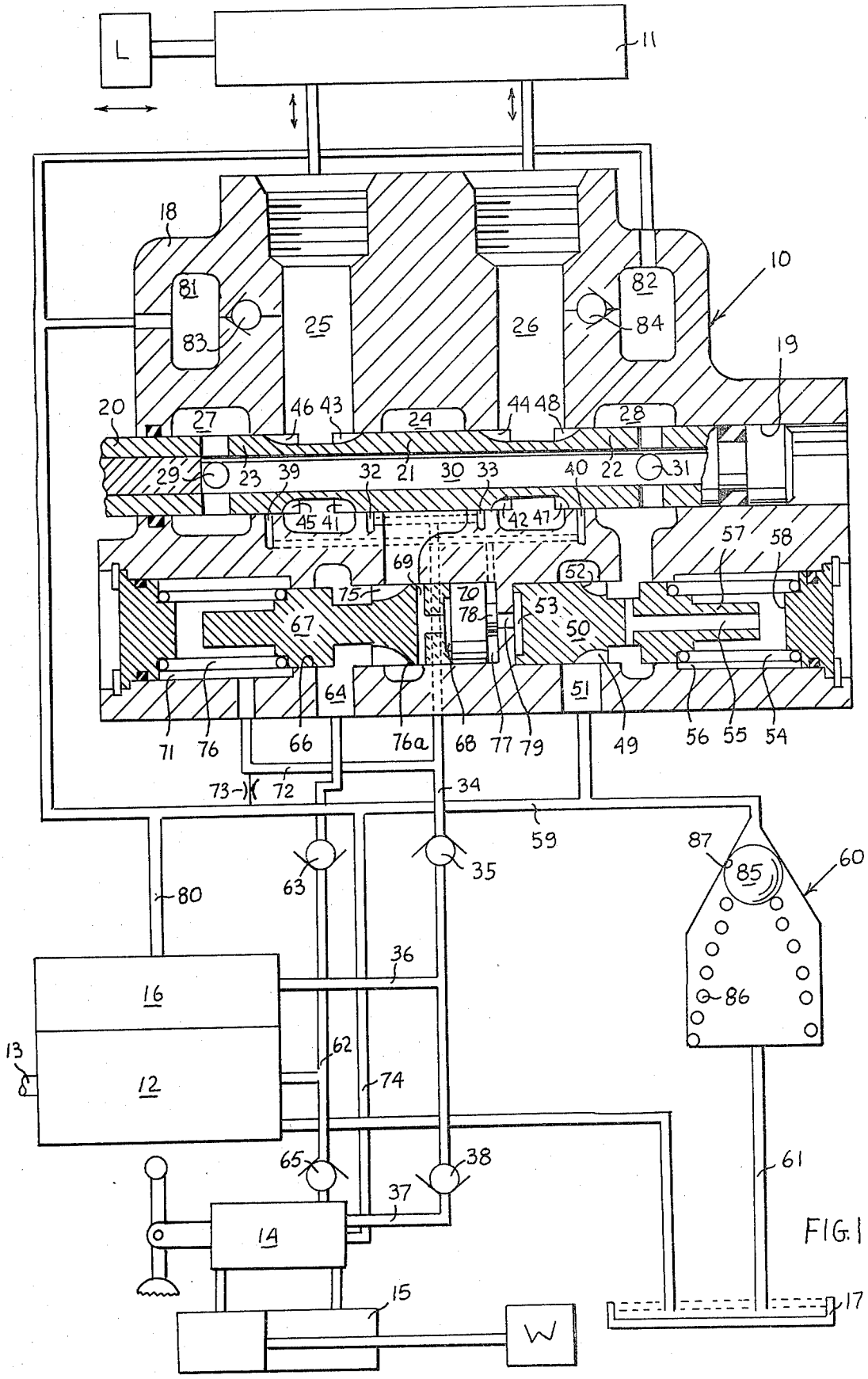
FIG. 1 is a longitudinal sectional view of an embodiment of a flow control valve having a positive load control responsive to actuator upstream pressure differential and negative load controls responsive to actuator down stream pressure differential for use in load responsive fluid control system, with lines, system flow control, system pump, second load responsive valve, exhaust relief valve and system reservoir shown diagramatically.

Referring now to FIG. 1, an embodiment of a flow control valve, generally designated as 10, is shown interposed between diagramatically shown fluid motor 11 driving load L and a pump 12 of a fixed displacement or variable displacement type driven through a shaft 13 by a prime mover not shown.

Similarly, a flow control valve 14, identical to flow control valve 10, is interposed between a diagramatically shown fluid motor 15 driving a load W and the pump 12. Fluid flow from the pump 12 to flow control valves 10 and 14 is regulated by a pump flow control 16. If pump 12 is of a fixed displacement type, pump flow control 16 is a differential pressure relief valve, which in a well known manner, by bypassing fluid from the pump 12 to a reservoir 17, maintains discharge pressure of pump 12 at a level, higher by a constant pressure differential, than load pressure developed in fluid motor 11 or 15. If pump 12 is of a variable displacement type, pump flow control 16 is a differential pressure compensator, well known in the art, which by changing displacement of pump 12 maintains discharge pressure of pump 12 at a level, higher by a constant pressure differential, than load pressure developed in fluid motor 11 or 15.

The flow control valve 10 is of a fourway type and has a housing 18 provided with a bore 19 axially guiding a valve spool 20. The valve spool 20 is equipped with lands 21, 22, 23 which in neutral position of the valve spool 20 as shown in FIG. 1 isolate a fluid supply chamber 24, load chambers 25 and 26 and outlet chambers 27 and 28. The outlet chamber 27 is connected through ports 29, central passage 30 in valve spool 20 and ports 31 to the outlet chamber 28.

Positive load sensing ports 32 and 33, located between load chambers 25 and 26 and the supply chamber 24 and blocked in neutral position of valve spool 20 by land 21, are connected through signal passage 34, a check valve 35 and signal line 36 to pump flow control 16. In a similar manner positive load sensing ports of flow control valve 14 are connected through line 37, a check valve 38 and signal line 36 to the pump flow control 16. Negative load sensing port 39 is located between load chamber 25 and outlet chamber 27. Similarly, negative load sensing port 40 is located between load chamber 26 and outlet chamber 28.

The land 21 of the valve spool 20 is equipped with signal slots 41 and 42, located in plane of positive load sensing ports 32 and 33 and metering slots 43 and 44, which, in a well known manner, can be circumferentially spaced in respect to each other and in respect to the signal slots 41 and 42. The land 23 is equipped with signal slot 45, located in plane of negative load sensing port 39 and circumferentially spaced metering slot 46. The land 22 is equipped with signal slot 47, located in plane of negative load sensing port 40 and circumferentially spaced metering slot 48. Signal slots 41, 42, 45 and 47, in a well known manner, can be substituted by end surfaces of lands 21, 22 and 23. A suitable device is provided to prevent relative rotation of the spool 20 in respect to bore 19.

The outlet chamber 28 is connected through slots 49, of a negative load control spool 50, to an exhaust chamber 51. The negative load control spool 50 having slots 49, provided with throttling edges 52, projects into control space 53 and is biased towards a position, as shown, by spring 54. The negative load control spool 50 is provided with passage 55 connecting the outlet chamber 28 with space 56 and is equipped with stop 57, limiting its displacement against surface 58. The exhaust chamber 51 in turn in connected through exhaust line 59, an exhaust relief valve, generally designated as 60, and line 61 to the reservoir 17.

The pump 12, through its discharge line 62 and load check 63, is connected to a fluid inlet chamber 64, Similarly, discharge line 62 is connected through load check valve 65 with the inlet chamber of the fluid control valve 14. The control bore 66 connects the fluid inlet chamber 64 with the fluid supply chamber 24. The control spool 67, axially slidable in control bore 66, projects on one end into space 68, connected to the fluid supply chamber 24 by passage 69 and abuts against a free floating piston 70. The control spool 67 on the other end projects into control space 71, which is connected by passage 72 with positive load sensing ports 32 and 33 and through leakage orifice 73 to exhaust line 59 and to upstream of exhaust relief valve 60. Similarly, control space and leakage orifice of the control valve 14 is connected by line 74 to upstream pressure of exhaust relief valve 60. The control spool 67 is provided with slots 75 terminating in throttling edges 76*a*, positioned between the inlet chamber 64 and the supply chamber 24. The control spool 67 is biased by a control spring 76 towards position, in which slots 75 connect the fluid supply chamber 24 with the fluid inlet chamber 64.

The free floating piston 70 on one end is subjected to pressure in space 68, which is connected to the fluid supply chamber 24 and on the other end is subjected to pressure in control space 77, which is connected to negative load pressure sensing ports 39 and 40. Projection 78 of the free floating piston 70, in the position as shown, effectively seals port 79 and control space 53 from control space 77.

The exhaust relief valve, generally designated as 60, is interposed between combined exhaust circuits of flow control valves 10 and 14, including bypass circuit of pump 12 and reservoir 17. The pressurized exhaust circuit of flow control valve 10 includes exhaust line 59 connected to bypass line 80 and connected to chambers 81 and 82, which are operationally connected for one way fluid flow by check valves 83 and 84 with load chambers 25 and 26. The exhaust relief valve 60 is provided with a throttling member 85, biased by a spring 86 towards engagement with seat 87.

If the pump 12 is of a fixed displacement type excess pump flow from the differential pressure relief valve or pump flow control 16 is delivered through line 80 to the exhaust line 59 and therefore to the total pressurized exhaust circuit of flow control valves 10 and 14.

The sequencing of the lands and slots of valve spool 20 preferably is such that when displaced in either direction from its neutral position, as shown in FIG. 1, one of the load chambers 25 or 26 is first connected by signal slots 41 or 42 to the positive load sensing port 32 or 33, while the other load chamber is connected by signal slots 45 or 47 to the negative load sensing port 39 or 40, while the load chambers 25 and 26 are still isolated from the supply chamber 24 and the outlet chambers 27 and 28. Further displacement of the valve spool 20 from its neutral position connects load chamber 25 or 26 to the supply chamber 24 through metering slots 43 or 44, while connecting the other load chamber through metering slots 46 or 48 with one of the oulet chambers 27 or 28.

Figure 2:
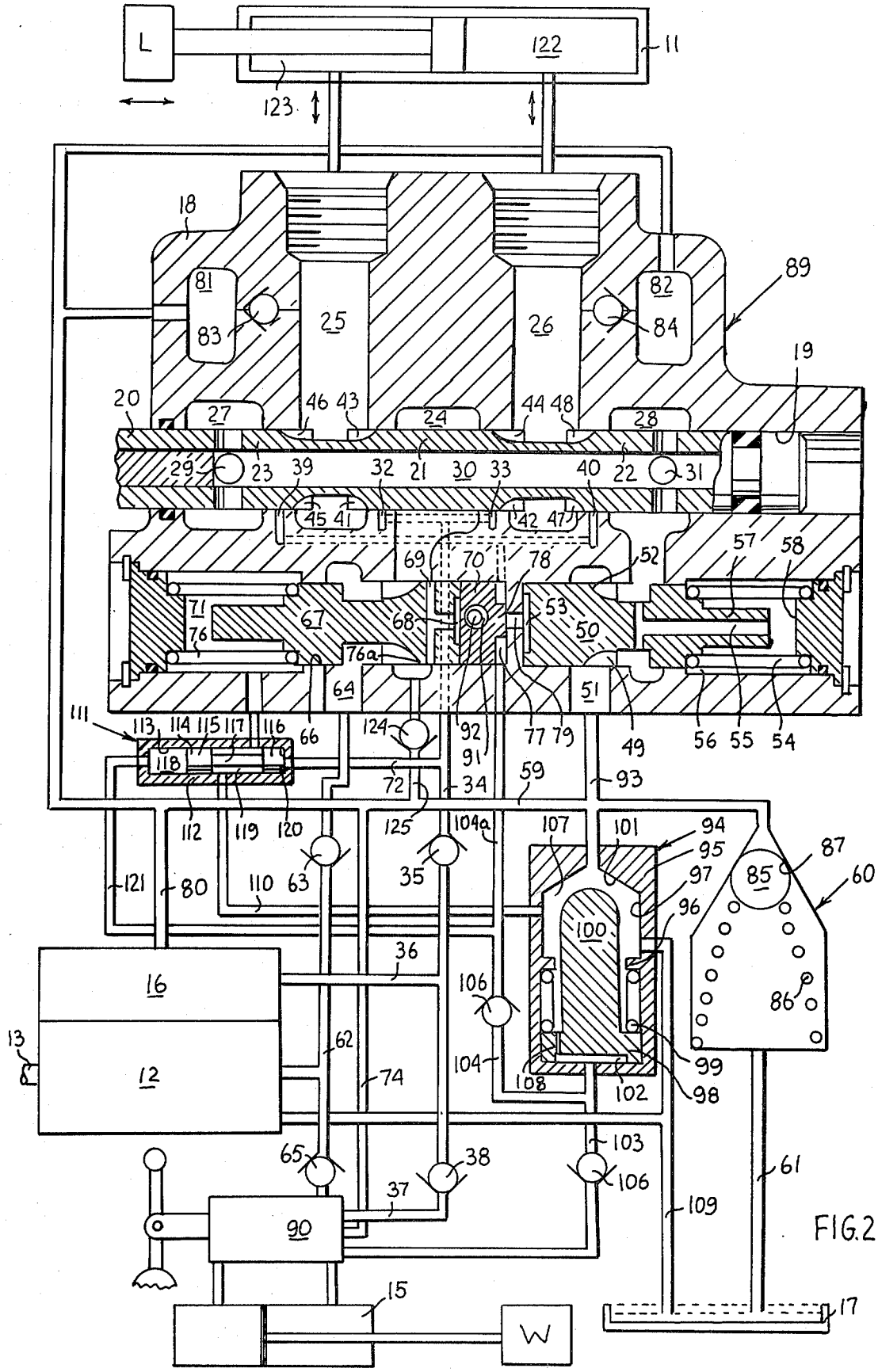
FIG. 2 is a longitudinal sectional view of an embodiment of a flow control valve similar to that of FIG. 1, but provided with the feature of supplementing actuator's inlet flow requirement from pressurized exhaust manifold by flow from pump discharge circuit, with lines, system flow controls, system pump, second load responsive valve, exhaust relief valve, exhaust unloading valve and system reservoir shown diagramatically.

Referring now to FIG. 2, a flow control valve generally designated as 89, is similar to the flow control valve 10 of FIG. 1, the same valve components being denoted by the same numbers. A flow control valve 90, similar to the flow control valve 89 is integrated into the circuit of FIG. 2. The free floating piston 70 of FIG. 1 in FIG. 2 is provided with transverse hole 91 containing stop pin 92. The exhaust chamber 51 is connected by line 93 with an exhaust unloading valve, generally designated as 94. The exhaust unloading valve 94 has a housing 95 provided with stop 96 and bore 97 guiding a plunger 98 biased, towards a position as shown in FIG. 2, by a spring 99. The plunger 98 is provided with a spherical head 100 selectively engaging seat 101. At the lower end the plunger 98 communicates with control space 102, which is phased by lines 103 and 104 and check valves 105 and 106 with negative load sensing ports 39 and 40 of the control valve 89 and similar negative load sensing ports of the flow control valve 90. Space 107 in the exhaust unloading valve 94 is connected through leakage orifice 108 with control space 102 and is also connected by line 109 to the system reservoir 17 and by line 110 to a signal unloading valve, generally designated as 111. The signal unloading valve 111 has a housing 112 provided with a bore 113 guiding a valve spool 114. The valve spool 114 is provided with lands 115 and 116 connected by stem 117, which define spaces 118, 119 and 120. Space 118 is connected by line 121 with negative load sensing ports 39 and 40. Space 119 is connected by line 110 with space 107 and therefore the system reservoir 17. Space 120 communicating with land 116 is connected by passage 72, upstream of check valve 35, with positive load sensing ports 32 and 33. The supply chamber 24 is connected for one way flow by check valve 124 and line 125 to exhaust line 59.

As previously described the pump flow control 16, in a well known manner, will regulate fluid flow delivered from pump 12 to discharge line 62, to maintain the pressure in discharge line 62 higher, by a constant pressure differential, than the highest load pressure signal transmitted through the check valve system to the signal line 36. Therefore with the valve spools of flow control valves 10 and 14 in their neutral position blocking positive load sensing ports 32 and 33, signal pressure input to the pump flow control 16 from the signal line 36 will be at minimum pressure level.

Referring now to FIG. 1, with pump 12 of a fixed displacement type started up, the pump flow control 16 will bypass through line 80, exhaust line 59, the exhaust relief valve 60 and line 61 all of pump flow to the system reservoir 17 at minimum pressure level equivalent to preload in the spring 86, while automatically maintaining pressure in discharge line 62 at a constant pressure, higher by a constant pressure differential, than pressure in signal line 36 or pressure in exhaust line 59. Therefore all of pump flow is diverted by the pump flow control 16 to the low pressure exhaust circuit, as previously described, without being used by flow control valves 10 and 14. Since signal line 36 is connected by passage 72 with control space 71, which is also connected through leakage orifice 73 to upstream of exhaust relief valve 60, the bypass pressure in the discharge line 62 will be higher, by a constant pressure differential, than the pressure in exhaust line 59, which equals the pressure setting of the exhaust relief valve 60. This pump bypass pressure transmitted through passage 69 to space 68 reacts on the cross-sectional area of control spool 67 and against the bias of control spring 76 moves the control spool 67 from right to left, closing with throttling edges 76a the passage between the inlet chamber 64 and the supply chamber 24.

With pump 12 of a variable displacement type, under working conditions, minimum flow to the system exhaust manifold composed of lines 80, 74, exhaust line 59 and exhaust pressure relief valve 60, may have to be diverted from the pump 12, to maintain the system exhaust manifold pressurized. A pressure reducing type regulator can be used, which upon sytem exhaust manifold pressure dropping below the setting of the exhaust pressure relief valve 60, will throttle some of the pump discharge flow and supply it to the exhaust manifold, to maintain it at a certain preselected minimum pressure level.

Assume that the load chamber 25 is subjected to a positive load. The initial displacement of the valve spool 20 to the right will connect the load chamber 25 through signal slot 41 with positive load sensing port 32, while lands 21, 22 and 23 still isolate the supply chamber 24, load chambers 25 and 26 and outlet chambers 27 and 28. As previously described positive load signal transmitted from positive load sensing port 32, through signal passage 34, check valve system and signal line 36 to the pump flow control 16 will increase the pressure in discharge line 62 to a level, which is higher by a constant pressure differential than the load pressure signal. The load pressure, transmitted through passage 72 to control space 71, will move the positive load control spool 67 to the right, opening through slots 75 communication between the inlet chamber 64 and the supply chamber 24. Communication will be maintained between the supply chamber 24 and the inlet chamber 64, as long as the pump flow control 16 maintains a constant pressure differential between the pump discharge pressure and the positive load pressure.

Further displacement of the valve spool 20 to the right will connect the load chamber 25, through metering slot 43, with the supply chamber 24 and will also connect metering slot 48 the load chamber 26 with the outlet chamber 28. In a manner as previously described, the pump flow control 16 will maintain a constant pressure differential across the orifice, created by displacement of metering slot 43, the flow into the load chamber 25 being proportional to the area of the orifice and therefore displacement of the valve spool 20 from its neutral position and independent of the magnitude of the load L. During control of positive load the free floating piston 70 is subjected to pressure in the supply chamber 24 and through negative load sensing port 40 to the low pressure in the load chamber 26. This pressure differential maintains the free floating piston 70 to the right closing with projection 78 and port 79 communication between control spaces 77 and 53, effectively deactivating the negative load control spool 50.

Assume that while controlling positive load L through the flow control valve 10, a higher positive W is actuated through the flow control valve 14. Higher load pressure signal from the flow control valve 14 will be transmitted through the check valve system to the pump flow control 16, which will now maintain system pressure, higher by a constant pressure differential, than pressure generated by positive load W. In a manner as previously described, the pressure drop through metering slot 43 will increase, therefore increasing the pressure differential between space 68 and control space 71. The positive load control spool 67 will move into its modulating position, throttling with throttling edges 76a the fluid flowing from the inlet chamber 64 to the supply chamber 24, to maintain a constant pressure differential between the supply chamber 24 and the load chamber 25, thus controlling fluid flow through metering slot 43. While this throttling control action takes place, control space 77 is connected through the negative load pressure sensing port 40 with low pressure existing in the load chamber 26. Free floating piston 70, subjected to pressure in the supply chamber 24 maintained to the right and closes with projection 78 port 79, leading to control space 53. In this way negative load control spool 50 becomes isolated from the negative load pressure signal and the negative load control spool 50 must remain inactive during control of positive load. This action of free floating piston 70 provides an effective interlock between positive and negative load controllers.

Assume that the load chamber 26 is subjected to a negative load L and that the valve spool 20 is displaced from its neutral position to the right while, as previously described, the positive load control 67 is maintained by the pump standby pressure in a position blocking communication between the inlet chamber 64 and the supply chamber 24. Initial displacement of the valve spool 20 will connect through signal slot 41 the load chamber 25 with the positive load sensing port 32. Since the load chamber 25 is subjected to low pressure neither the pump flow control 16 nor the positive load control spool 67 will react to it. Simultaneously signal slot 47 will be connected to the negative load sensing port 40, connecting the load chamber 26, subjected to negative load pressure through signal passages with control space 77. Since the control spool 67, biased by control spring 76, is contacting the free floating piston 70, the pressure differential, developed between control space 71 and control space 77 will move the free floating piston 70 and the control spool 67 to the left, opening with projection 78 port 79, cross-connecting control space 77 with control space 53. Under action of negative load pressure, supplied from the negative load pressure sensing port 40, the free floating piston 70 will move control spool 67 all the way to the left, isolating with throttling edges 76a the supply chamber 24 from the inlet chamber 64. At the same time negative load pressure from control space 77, transmitted through port 88 to control space 53, reacting on the cross-sectional area of negative load control 50 will move it, against the biasing force of spring 54, all the way to the right, with throttling edges 52 cutting off communication between the outlet chamber 28 and the exhaust chamber 51.

Further displacement of valve spool 20 to the right will connect through metering slot 48 the load chamber 26 with the outlet chamber 28, while also connecting through metering slots 43 the load chamber 25 with the supply chamber 24. Since the outlet chamber 28 is isolated by position of the negative load control spool 50, the pressure in the outlet chamber 28 will begin to rise, until it will reach a level, at which force generated on the cross-sectional area of the negative load control spool 50, by the pressure in control space 53, will equal the sum of the force generated on the same cross-sectional area by the pressure in the outlet chamber 28 and therefore pressure in space 56 and the biasing force of the spring 54. At this point the negative load control spool 50 will move from right to left, into a modulating position, in which fluid flow from the outlet chamber 28 to the exhaust chamber 51 will be throttled by the throttling edges 52, to automatically maintain a constant pressure differential, equivalent to the biasing force of the spring 54, between the load chamber 26 and the outlet chamber 28. Since during control of negative load a constant pressure differential is maintained across the orifice, created by the displacement of metering slot 48, by the throttling action of negative load control spool 50, fluid flow through metering slot 48 will be proportional to the displacement of the valve spool 20 and constant for each specific position of metering slot 48, irrespective of the change in the magnitude of the negative load L.

As previously described, during control of negative load the control spool 67 will be maintained by the free floating piston 70 in a position, where it isolates the inlet chamber 64 from the supply chamber 24. The inlet flow requirement of load chambers 25 and 26 is supplied through check valves 83 and 84 from the outlet flow from one of the load chambers and total system exhaust flow available from the exhaust manifold, pressurized by the exhaust relief valve 60. The pressure setting of the exhaust relief valve 60 is high enough to provide the necessary pressure drop through check valve 83, at the highest rates of flow from the exhaust manifold to the load chamber 25, without pressure in the load chamber 25 dropping below atmospheric level, thus preventing any possibility of cavitation. In this way, during control of negative load, the inlet flow requirement of the actuator is not supplied from the pump circuit but from the pressurized exhaust circuit of flow control valves 10 and 14, conserving the pump flow and increasing system efficiency. If negative load pressure is not sufficiently high to provide a constant pressure drop through metering slot 48, the negative load control spool 50 will move to the left from its modulating and throttling position, the negative load pressure in the load chamber 26 and control space 77 will drop to a level at which the pressure in space 68, due to the setting of the exhaust relief valve 60, with the biasing force of control spring 76 will move the free floating piston 70 to the right together with the control spool 67 with projection 78 closing port 79. The check valve 83 will close and the control system will revert to its positive load mode of operation, providing the energy to load L from the the pump circuit to maintain a constant pressure differential across metering slot 43. During control of negative load the inlet flow requirement of the actuator is supplied from the outlet flow from the actuator, bypass flow from pump flow control and the exhaust circuits of all of the other system flow control valves through check valves 83 and 84.

During control of negative load, with valve spool 20 displaced to the left, the metering slot 46 throttles the oil flow to outlet chamber 27 and this flow is supplied through ports 29, central passage 30 in valve spool 20 and ports 31 to the outlet chamber 28. Therefore ports 29, central passage 20 and ports 31 cross-connect outlet chambers 27 and 28 permitting bidirectional control of negative load.

Referring now to FIG. 2, with pump 12 of fixed displacement type started up, pump flow control 16 with bypass through line 80, exhaust line 59, the exhaust unloading valve 94 and line 109 all of pump flow to the system reservoir 17, at minimum pressure level, completely bypassing the exhaust relief valve 60, while automatically maintaining pressure in discharge line 62 at a constant pressure, higher by a constant pressure differential than pressure in signal line 36 or pressure in exhaust line 59. If this pressure differential, of flow control 16, is higher than that, equivalent to preload in the control spring 76, the control spool 67 will move from right to left, closing with throttling edges **76*a* the passage between the inlet chamber 64 and the supply chamber 24**.

With pump 12 of a variable displacement type started up, the flow control 16 will automatically move the pump displacement to near zero flow position, maintaining a constant pressure in discharge line 62, higher by a constant pressure differential than pressure in signal line 36, or pressure in exhaust line 59. If this pressure differential is higher than the working pressure differential of control spool 67, due to the biasing force of the control spring 76, the control spool 67 will move from right to left, closing with throttling edges **76*a* the passage between the inlet chamber 64 and the supply chamber 24. Under those conditions only minimum exhaust flow, due to system leakage, will be transferred through exhaust line 59 and the exhaust unloading valve 94 to the system reservoir 17**.

Assume that the load chamber 25 is subjected to a positive load, while the load chamber 26 is subjected to low pressure. The initial displacement of the valve spool 20 to the right will connect the load chamber 25 through signal slot 41 with positive load sensing port 32 and connect the load chamber 26 through signal slot 47 with the negative load sensing port 40, while lands 21, 22 and 23 still isolate the supply chamber 24, load chambers 25 and 26 and outlet chambers 27 and 28. Positive load pressure signal from positive load sensing port 32 will be transmitted through passage 72 to space 120, where it will react on the cross-sectional area of the valve spool 114. Since space 118 is connected through line 121 with low pressure in negative load sensing port 40, the valve spool 114 will move all the way from right to left, connecting by displacement of land 116 the positive load sensing port 32 with control space 71. Simultaneously positive load pressure signal will be transmitted from positive load sensing port 32 through signal passage 34, check valve 35 and signal line 36 to the pump flow control 16, while check valve 38 will remain closed. Load pressure signal, transmitted to the pump flow control 16, will increase the pressure in discharge line 62 to a level, which is higher by a constant pressure differential than the load pressure signal. The load pressure, transmitted through passage 72 to control space 71, will move the positive load control spool 67 to the right, opening through slots 75 communication between the inlet chamber 64 and the supply chamber 24. Communication will be maintained between the supply chamber 24 and the inlet chamber 64, as long as the pump flow control 16 maintains a constant pressure differential between the pump discharge pressure and the positive load pressure. Since the supply chamber 24 is subjected to pump pressure, higher than load pressure in the load chamber 25, this pressure, transmitted to space 68, will react on the cross-sectional area of the free floating piston 70. Since control space 77 is subjected to low pressure in load chamber 26, the free floating piston 70, with its projection 78, will block port 79, effectively closing communication between negative load sensing port 40 and control space 53. The low pressure control signal from the load chamber 26 is also transmitted from negative load sensing port 40 through line **104*a*, check valve 106 and line 104 to control space 102, where it reacts on the cross-sectional area of the plunger 98. The spring 99 is provided with sufficient preload to maintain the plunger 98 in its position, as shown in FIG. 2. Therefore, during control of positive load, the combined exhaust circuits of flow control valves 89 and 90 are directly connected to system reservoir 17 through action of the exhaust unloading valve 94**.

Further displacement to the right of the valve spool 20 will connect the load chamber 25, through metering slot 43 with the supply chamber 24 and will also connect, through metering slot 48, the load chamber 26 with the outlet chamber 28. Since the signal unloading valve 111 connects the load chamber pressure with control space 71, the positive load control of FIG. 2 will act in an identical way as the positive load control of FIG. 1 and the pump flow control 16 will maintain a constant pressure differential across the orifice, created by displacement of metering slot 43.

Assume that flow control valve 90 controls a positive load W higher than load L. Again, in a manner as previously described when referring to FIG. 1, the control spool 67 will automatically assume a modulating control position, throttling the fluid flow from the inlet chamber 64 to the supply chamber 24, to maintain a constant pressure differential between the supply chamber 24 and the load chamber 25. The flow into the load chamber 25 through the metering slot 43 will be proportional to the area of the created orifice and therefore to the displacement of the valve spool 20 from its neutral position and independent of the magnitude of the loads W and L.

Although the operation of control valves of FIGS. 1 and 2 when controlling positive loads is identical, with the exception of the exhaust circuit of FIG. 2 being completely unloaded, while the exhaust circuit of FIG. 1 is pressurized by the exhaust relief valve 60, the operation of the control valve of FIG. 2, when controlling a negative load, is substantially different from that of FIG. 1.

Assume that the load chamber 26 is subjected to a negative load L and that the valve spool 20 is displaced from its neutral position to the right. Initial displacement of the valve spool 20 will connect through signal slot 41 the load chamber 25 with the positive load sensing port 32, while simultaneously connecting through signal slot 47 the load chamber 26 with negative load sensing port 40. The pressure differential, existing between the negative and positive load sensing ports, acting on the cross-sectional area of valve spool 114 of the signal unloading valve 111, will move it from left to right to the position as shown in FIG. 2, connecting the control space 71 through space 119, line 110, space 107 and line 109 to system reservoir. Since the supply chamber 24 and space 68 are subjected to minimum discharge pressure of the pump 12 and since control space 77 is subjected to negative load pressure, the free floating piston 70 will move from right to left, through a distance equivalent to the clearance between transverse hole 91 and the stop pin 92, opening communication between control space 77 through port 79 to control space 53, subjecting the negative load control spool 50 to negative load pressure. Under action of negative load pressure, supplied from the negative load sensing port 40, the negative load control spool 50 will be moved all the way to the right against the biasing force of spring 54, with throttling edges 52 cutting off communication between the outlet chamber 28 and the exhaust chamber 51. At the same time the negative load pressure, from negative load sensing port 40, will be transmitted from space 77 through line 104*a*, check valve 106 and line 104 to control space 102 where, reacting on the cross-sectional area of the plunger 98, will move it against the biasing force of spring 99 all the way up, the spherical head 100 engaging seat 101 and disrupting the flow of exhaust fluid to the reservoir 17. If the pump 12 is of a fixed displacement type, the pressure in exhaust line 59 will rise to a sufficient level to open the flow passage through the exhaust relief valve 60, the pump bypass flow being discharged to the exhaust manifold at the pressure, as dictated by the pressure setting of the exhaust relief valve 60. Therefore when controlling a negative load the total exhaust system of the flow control valves 89 and 90 is maintained at a level, equivalent to the comparatively high setting of the exhaust relief valve 60, while when controlling a positive load the exhaust system is completely unloaded and directly connected to system reservoir.

Further displacement of valve spool 20 to the right will connect through metering slot 48 the load chamber 26 with the outlet chamber 28, while also connecting through metering slot 43 the load chamber 25 with the supply chamber 24. Since the outlet chamber 28 is isolated from the exhaust chamber 51 by position of the negative load control spool 50, the pressure in the outlet chamber 28 will begin to rise, until it will reach a level, at which force generated on the cross-sectional area of the negative load control spool 50, by pressure in control space 53, will equal the sum of the force generated on the same cross-sectional area by the pressure in the outlet chamber 28 and therefore pressure in the space 56 and the biasing force of the spring 54. At this point the negative load control spool 50 will move from right to left into a modulating position, in which fluid flow from the outlet chamber 28 to the exhaust chamber 51 will be throttled by the throttling edges 52, to automatically maintain a constant pressure differential, equivalent to biasing force of the spring 54, between the load chamber 26 and the outlet chamber 28. Since during control of negative load a constant pressure differential is maintained across the orifice, created by displacement of metering slot 48, by throttling action of negative load control spool 50, fluid flow through metering slot 48 will be proportional to the displacement of the valve spool 20 and constant for each specific position of metering slot 48, irrespective of the change in the magnitude of the negative load L.

Since during control of negative load, as previously described, the valve spool 114, of the signal unloading valve 111, automatically connects control space 71 with system reservoir, the control spool 67, deprived of the control pressure signal, will act as a pressure reducing valve, throttling the oil flow between the inlet chamber 64 and the supply chamber 24, to maintain the supply chamber 24 at a constant pressure, equivalent to preload in the control spring 76. The preload in the spring 86 of the exhaust relief valve 60 is so selected that the exhaust pressure in exhaust line 59 is higher than the constant pressure, maintained in the supply chamber 24 by the control spool 67. Since the fluid under exhaust manifold pressure will be supplied through exhaust line 59 to chamber 81 and from the chamber 81 through check valve 83 to the load chamber 25, this pressure will communicate through metering slot 43 with the supply chamber 24. The exhaust manifold pressure will also be supplied to the supply chamber 24 through the check valve 124. Therefore the supply chamber 24 will be subjected to the pressure of the exhaust relief valve 60, which is higher than the constant reduced pressure setting of the control spool 67. Therefore control spool 67 will move from a modulating position to the left, cutting off with throttling edges 76*a* communication between inlet chamber 64 and supply chamber 24. Therefore during control of negative load, as long as the high exhaust pressure is maintained by the exhaust relief valve 60 in the exhaust manifold, all of the inlet flow requirement of the actuator 11 is supplied through check valve 83 from the exhaust manifold, the control spool 67 effectively isolating the pump discharge circuit from the inlet chamber 24, the load chamber 25 and the piston rod end space 123 of the fluid motor 11. Since the displacement of fluid from piston end space 122 is much larger than the inlet flow requirement into piston rod end space 123, there is enough fluid to supply all of the inlet flow requirement of the fluid motor 11, without utilizing any of the discharge flow from the pump 12. At the same time the difference in volume between the outlet flow from piston end space 122 and the inlet flow to the piston rod end space 123 is passed through the exhaust relief valve 60.

Assume that the load chamber 25 is subjected to negative load and that the valve spool 20 was moved from right to left, connecting with metering slot 46 the load chamber 25 with the outlet chamber 27, while also connecting through metering slot 44 the load chamber 26 with the supply chamber 24. The flow from the outlet chamber 27 will be transferred through central passage 30 and ports 31 to the outlet chamber 28 and the negative load control spool 50, in a manner as described above, will assume a modulating position, to throttle fluid flow between the outlet chamber 28 and the exhaust chamber 51, to maintain a constant pressure differential across the metering orifice of the metering slot 46. Due to negative load pressure, the exhaust unloading valve 94 will be closed and the signal unloading valve 111 will connect the control space 71 with system reservoir, converting control spool 67 into its constant pressure reducing mode of operation. However, since the inlet flow requirement of piston end space 122 exceeds now the outlet flow from piston rod end space 123, the pressure in the exhaust circuit will drop and the exhaust relief valve 60 will close. As soon as the exhaust pressure, supplied by check valve 84 will drop in the load chamber 26 and the supply chamber 24 below the constant pressure setting of the control spool 67, the control spool 67 will move from left to right and will throttle through slots 75, fluid flow from the inlet chamber 64 to the supply chamber 24, to maintain the supply chamber 24 at a constant pressure, as dictated by the preload in the control spring 76. Therefore the exhaust manifold, completely isolated from the system reservoir 17 by the exhaust relief valve 60, will now be maintained at a lower pressure as dictated by the pressure reducing action of the control spool 67, the control spool 67 throttling enough of the fluid from the pump discharge circuit to supplement the outlet flow from piston rod space 123. Therefore, while controlling negative load when the inlet flow requirement of the fluid motor exceeds its outlet flow, the difference between the in and out flow of the actuator will be automatically supplied from the pump discharge circuit. The difference between the inlet and outlet flow requirement of the motor is usually caused, as is well known in the art, by the presence of the piston rod. Therefore when controlling a negative load from the piston rod end of the actuator, the pump will automatically supply into the flow from the exhaust circuit the fluid volume, equal to the displacement of the piston rod of the motor. When controlling the negative load from the piston end of the motor, since the excess exhaust flow is available to satisfy the inlet flow requirement of the fluid motor, no flow is delivered by the throttling action of the control spool 67 into the motor inlet and the volume of fluid, equal to the displacement of the piston rod, is passed through the exhaust relief valve 60 at its pressure setting.

With the control system of FIG. 2, during control of positive load, the exhaust manifold of the system is maintained at reservoir pressure, providing a very efficient system. During control of negative load the exhaust manifold is subjected to comparatively high pressure, all of the exhaust flow being available to satisfy the inlet flow requirement of the actuator controlling negative load, saving flow from the pump discharge circuit and therefore increasing not only the capability of the pump to perform work, but also increasing the system efficiency. If the actuator inlet flow requirement exceeds the flow supplying capability of the exhaust manifold, the required difference in flows is automatically throttled from the pump discharge circuit by the positive load control valve, which during positive load control mode of operation acts as a throttling valve, maintaining a constant pressure differential and during negative control mode of operation acts as a constant minimum pressure reducing valve.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly supplied with pressure fluid by a pump, said valve assembly comprising a housing having a fluid inlet chamber, a fluid supply chamber, first and second load chambers, positive load pressure sensing means, negative load pressure sensing means, and exhaust means, first valve means for selectively interconnecting said fluid load chambers with said positive load pressure sensing means and said negative load pressure sensing means, said supply chamber and said exhaust means, first variable metering orifice means responsive to movement of said first valve means between said fluid supply chamber and said load chambers, second variable metering orifice means responsive to movement of said first valve means between said load chambers and said exhaust means, second valve means having inlet fluid throttling means between said fluid inlet chamber and said fluid supply chamber having means operable to maintain pressure differential across said first variable metering orifice means at a relatively constant level, third valve means having outlet fluid throttling means between said load chamber and said exhaust means having means operable to maintain pressure differential across said second variable metering orifice means at a relatively constant level and synchronizing means having means responsive to pressure in said supply chamber, means responsive to pressure in said negative load pressure sensing means and deactivating means, said synchronizing means operable to deactivate said third valve means when pressure in said supply chamber is higher than pressure in said negative load pressure sensing means.

2. A valve assembly as set forth in claim 1 wherein said positive load pressure sensing means have means operable to transmit a control signal to said pump.

3. A valve assembly as set forth in claim 1 wherein said second valve means has inlet fluid isolating means to isolate fluid flow between said fluid inlet chamber and said fluid supply chamber.

4. A valve assembly supplied with pressure fluid by a pump, said valve assembly comprising a housing having a fluid inlet chamber, a fluid supply chamber, first and second load chambers, positive load pressure sensing means, negative load pressure sensing means, and exhaust means, first valve means for selectively interconnecting said fluid load chambers with said positive load pressure sensing means and said negative load pressure sensing means, said supply chamber, and said exhaust means, first variable metering orifice means responsive to movement of said first valve means between said fluid supply chamber and said load chambers, second variable metering orifice means responsive to movement of said first valve means between said load chambers and said exhaust means, second valve means having inlet fluid throttling means between said fluid inlet chamber and said fluid supply chamber and control means of said fluid throttling means having force means responsive to fluid pressure in said positive load pressure sensing means, and deactivating means of said force means having valve means operable to connect said second valve means with said exhaust means.

5. A valve assembly as set forth in claim 4 wherein said deactivating means has means responsive to pressure in said negative load pressure sensing means.

6. A valve assembly as set forth in claim 4 wherein said deactivating means have means responsive to pressure differential between said negative load pressure sensing means and said positive load pressure sensing means.

7. A valve assembly as set forth in claim 4 wherein said deactivating means has connecting means to said exhaust means.

8. A valve assembly as set forth in claim 4 wherein said fluid throttling means has isolating means operable to isolate said inlet chamber from said supply chamber.

9. A valve assembly as set forth in claim 4 wherein said valve housing has fluid replenishing means for one way fluid flow between said supply chamber and said exhaust means.

10. A valve assembly as set forth in claim 4 wherein said valve housing has fluid replenishing means between said load chambers and said exhaust means.

11. A valve assembly as set forth in claim 4 wherein third valve means having throttling means responsive to pressure in said negative load pressure sensing means is interposed between said load chambers and said exhaust means.

12. A valve assembly supplied with pressure fluid by a pump, said valve assembly comprising a housing having a fluid inlet chamber, a fluid supply chamber, first and second load chambers, positive load pressure sensing means, negative load pressure sensing means, and exhaust means, first valve means for selectively interconnecting said fluid load chambers with said positive load pressure sensing means and said negative load pressure sensing means, said supply chamber and said exhaust means, first variable metering orifice means responsive to movement of said first valve means between said fluid supply chamber and said load chambers, second variable metering orifice means responsive to movement of said first valve means between said load chambers and said exhaust means, second valve means having inlet fluid throttling means and inlet fluid isolating means between said fluid inlet chamber and said fluid supply chamber and control means of said fluid throttling means having force means responsive to fluid pressure in said positive load pressure sensing means, deactivating means of said force means having valve means operable to connect said second valve means with said exhaust means, exhaust relief valve means in said exhaust means and fluid replenishing means functionally interconnecting for one way fluid flow said exhaust means upstream of said exhaust valve means and said first and second load chambers.

13. A valve assembly as set forth in claim 12 wherein said fluid replenishing means has check valve means between said exhaust means upstream of said exhaust relief valve means and said supply chamber.

14. A valve assembly as set forth in claim 12 wherein said fluid replenishing means has check valve means between said exhaust means upstream of said exhaust relief valve means and said first and second load chambers.

15. A valve assembly as set forth in claim 12 wherein said deactivating means has means responsive to pressure differential between said negative load pressure sensing means and said positive load pressure sensing means.

16. A valve assembly as set forth in claim 12 wherein said deactivating means has connecting means to said exhaust means down stream of said exhaust relief valve means.

17. A valve assembly as set forth in claim 12 wherein third valve means having throttling means responsive to pressure in said negative load pressure sensing means is interposed between said load chambers and said exhaust means.

18. A load responsive valve assembly comprising a housing having fluid inlet means connected to a pump, first and second load chambers and fluid exhaust means connected to reservoir means, first valve means for selectively interconnecting said fluid load chambers with said fluid inlet means and said fluid exhaust means, said first valve means having fluid throttling means operable to throttle fluid flow between said load chambers and said fluid exhaust means, pressure sensing means to sense pressure upstream of said fluid throttling means selectively communicable with said load chambers by said first valve means, exhaust relief valve means interposed between said fluid exhaust means and said reservoir means, and exhaust pressure unloading means in said fluid exhaust means having means responsive to said pressure sensing means.

19. A load responsive valve assembly as set forth in claim 18 wherein said exhaust pressure unloading means has exhaust fluid bypass means for selectively interconnecting said fluid exhaust means upstream of exhaust relief valve means and said reservoir means.

20. A load responsive valve assembly as set forth in claim 18 wherein check valve means operable for one way fluid flow interconnect said first and second load chambers and said fluid exhaust means upstream of said exhaust relief valve means.

21. Multiple load responsive valve assemblies each comprising a housing having a fluid inlet chamber connected to pump means, a fluid supply chamber, first and second load chambers and fluid exhaust means connected to reservoir means, load pressure sensing means operable to transmit a control signal to said pump means and selectively communicable with said load chambers, first valve means for selectively interconnecting said fluid load chambers with said fluid supply chamber, said load pressure sensing means and said fluid exhaust means, said first valve means having metering orifice means operable to throttle fluid flow between said load chambers and said fluid exhaust means, pressure sensing means to sense pressure upstream of said metering orifice means, exhaust manifold means interconnecting said fluid exhaust means of said valve assemblies upstream of said reservoir means, exhaust relief valve means interposed between said exhaust manifold means and said reservoir means and exhaust pressure unloading means in said exhaust manifold means, duct means interconnecting said pressure sensing means to sense pressure upstream of said metering orifice means of each of said valve assemblies and said exhaust pressure unloading means, said exhaust pressure unloading means having means responsive to said pressure sensing means operable to interconnect said exhaust manifold means and said reservoir means to bypass said exhaust relief valve means.

22. Multiple load responsive valve assemblies as set forth in claim 21 wherein check valve means is interposed between said pressure sensing means of each of said valve assemblies and said exhaust pressure unloading means.

* * * * *